US006182366B1

(12) United States Patent
Richard

(10) Patent No.: US 6,182,366 B1
(45) Date of Patent: Feb. 6, 2001

(54) FLEXIBLE RAZOR ASSEMBLY AND CARTRIDGE

(75) Inventor: Paul Richard, Shelton, CT (US)

(73) Assignee: Warner-Lambert Company, Morris Plains, NJ (US)

( * ) Notice: Under 35 U.S.C. 154(b), the term of this patent shall be extended for 0 days.

(21) Appl. No.: 09/295,880

(22) Filed: Apr. 21, 1999

(51) Int. Cl.[7] ..... B26B 21/14

(52) U.S. Cl. ..... 30/50; 30/49; 30/47

(58) Field of Search ..... 30/47, 49, 50, 30/41

(56) References Cited

U.S. PATENT DOCUMENTS

| | | | |
|---|---|---|---|
| 1,920,711 | | 8/1933 | Pelizzola . |
| 2,127,881 | | 8/1938 | Morris . |
| 2,487,886 | | 11/1949 | McCune . |
| 3,262,206 | | 7/1966 | Tomek . |
| 3,660,893 | | 5/1972 | Welsh . |
| 3,786,563 | | 1/1974 | Dorion, Jr. et al. . |
| 3,935,639 | | 2/1976 | Terry et al. . |
| 3,975,820 | | 8/1976 | Torance . |
| 4,026,016 | | 5/1977 | Nissen . |
| 4,069,580 | * | 1/1978 | Cartwright et al. ..... 30/47 |
| 4,146,958 | | 4/1979 | Chen et al. . |
| 4,200,976 | | 5/1980 | Gooding . |
| 4,227,302 | | 10/1980 | Torrance . |
| 4,266,340 | | 5/1981 | Bowman . |
| 4,270,268 | | 6/1981 | Jacobson . |
| 4,281,455 | | 8/1981 | Dixon et al. . |
| 4,288,920 | | 9/1981 | Douglass et al. . |
| 4,335,508 | | 6/1982 | Francis et al. . |
| 4,345,374 | | 8/1982 | Jacobson . |
| 4,347,663 | | 9/1982 | Ullmo . |

(List continued on next page.)

FOREIGN PATENT DOCUMENTS

| | | |
|---|---|---|
| 56-43437 | 10/1981 | (JP) . |
| 0583177 | 1/1983 | (JP) . |
| 58-88974 | 6/1983 | (JP) . |
| 58-138571 | 9/1983 | (JP) . |
| 58-138572 | 9/1983 | (JP) . |
| 0602476 | 1/1985 | (JP) . |
| 60-179277 | 11/1985 | (JP) . |
| 0636577 | 5/1994 | (JP) . |
| 6039644 | 5/1994 | (JP) . |
| 0655562 | 8/1994 | (JP) . |
| 6509243 | 10/1994 | (JP) . |
| 7501252 | 2/1995 | (JP) . |
| 9502912 | 3/1997 | (JP) . |
| 2546261 | 5/1997 | (JP) . |
| 9135972 | 5/1997 | (JP) . |
| 9135973 | 5/1997 | (JP) . |
| 9168677 | 6/1997 | (JP) . |
| 9187585 | 7/1997 | (JP) . |
| 9276567 | 10/1997 | (JP) . |
| 9276568 | 10/1997 | (JP) . |
| 9285663 | 11/1997 | (JP) . |
| 0998906 | 12/1997 | (JP) . |
| 9308779 | 12/1997 | (JP) . |
| 9308780 | 12/1997 | (JP) . |
| 9308781 | 12/1997 | (JP) . |
| 10500888 | 1/1998 | (JP) . |
| 6 3139873 | 9/1998 | (JP) . |
| 10290891 | 11/1998 | (JP) . |
| WO9310947 | 6/1993 | (WO) . |
| WO 95/05272 | 2/1995 | (WO) . |
| WO9509071 | 4/1995 | (WO) . |
| WO9629183 | 9/1996 | (WO) . |
| WO9737818 | 10/1997 | (WO) . |
| WO9805478 | 2/1998 | (WO) . |
| WO9920440 | 4/1999 | (WO) . |

*Primary Examiner*—Hwei-Siu Payer
(74) *Attorney, Agent, or Firm*—Charles W. Almer

(57) ABSTRACT

A flexible razor cartridge and assembly are provided. The razor cartridge includes at least one longitudinally arranged flexible beam biased to facilitate a flexed cartridge to return to its at rest position.

32 Claims, 9 Drawing Sheets

U.S. PATENT DOCUMENTS

| | | | | |
|---|---|---|---|---|
| 4,378,634 | | 4/1983 | Jacobson . | |
| 4,407,067 | | 10/1983 | Trotta . | |
| 4,428,116 | | 1/1984 | Chen et al. . | |
| 4,442,598 | | 4/1984 | Jacobson . | |
| 4,443,939 | * | 4/1984 | Motta et al. | 30/49 |
| 4,480,387 | | 11/1984 | d'Alayer de Costemore d'Arc . | |
| 4,488,357 | | 12/1984 | Jacobson . | |
| 4,492,025 | | 1/1985 | Jacobson . | |
| 4,501,066 | | 2/1985 | Sceberras . | |
| 4,514,904 | | 5/1985 | Bond . | |
| 4,516,320 | * | 5/1985 | Peleckis | 30/49 |
| 4,534,110 | | 8/1985 | Glass . | |
| 4,640,012 | | 2/1987 | Thomas . | |
| 4,756,082 | | 7/1988 | Apprille, Jr. . | |
| 4,797,998 | | 1/1989 | Motta . | |
| 4,813,131 | | 3/1989 | Gruner . | |
| 4,901,437 | | 2/1990 | Iten . | |
| 4,916,814 | | 4/1990 | Althaus . | |
| 4,941,492 | | 7/1990 | Morgan . | |
| 4,980,974 | | 1/1991 | Radcliffe . | |
| 5,003,694 | * | 4/1991 | Chen | 30/49 |
| 5,031,316 | * | 7/1991 | Oldroyd | 30/47 |
| 5,038,472 | | 8/1991 | Iderosa . | |
| 5,046,249 | | 9/1991 | Kawara et al. . | |
| 5,070,614 | | 12/1991 | Hardin et al. . | |
| 5,157,834 | | 10/1992 | Chen et al. . | |
| 5,313,705 | * | 5/1994 | Rivers et al. | 30/50 |
| 5,333,383 | | 8/1994 | Ferraro . | |
| 5,343,622 | | 9/1994 | Andrews . | |
| 5,377,409 | * | 1/1995 | Chen | 30/41 |
| 5,388,332 | * | 2/1995 | Oldroyd | 30/50 |
| 5,402,574 | | 4/1995 | Milner . | |
| 5,410,810 | * | 5/1995 | Gillibrand | 30/41 |
| 5,426,851 | | 6/1995 | Gilder et al. . | |
| 5,522,137 | | 6/1996 | Andrews . | |
| 5,546,660 | | 8/1996 | Burout et al. . | |
| 5,661,907 | | 9/1997 | Apprille, Jr. . | |
| 5,781,997 | * | 7/1998 | Ferraro et al. | 30/50 |
| 5,787,586 | | 8/1998 | Apprille, Jr. et al. . | |
| 5,799,549 | | 9/1998 | Decker et al. . | |
| 5,813,293 | | 9/1998 | Apprille, Jr. et al. . | |

* cited by examiner

FLEXIBLE RAZOR ASSEMBLY AND CARTRIDGE

FIELD OF THE INVENTION

The present invention relates to flexible razor cartridges and razor assemblies having such flexible cartridges.

BACKGROUND OF THE INVENTION

In recognition of the fact that surfaces to be shaved are not perfectly planar, razor cartridges have been designed to flex during shaving. In order to maximize the flexibility of the cartridges, including associated blades, various designs have been developed. For example, one advantageous design is disclosed in U.S. Pat. No. 5,475,923 where a segmented guard bar is utilized. That design has proven to be very successful in providing overall flexibility to the razor cartridge without noticeable distortion to the blade geometry during shaving.

The consistent achievement of a close, safe and comfortable shave depends upon careful control of the blade geometry. While prior art designs including the design discussed above in connection with the '923 patent have been acceptable, a need continues to exist for a razor cartridge with improved flexibility.

The present invention overcomes the drawbacks of the prior art by providing a razor cartridge which may include one or more blades which utilizes flexible beams to provide enhanced flexibility.

SUMMARY OF THE INVENTION

One aspect of the present invention is directed toward a flexible razor cartridge comprising a frame and at least one blade supported on the frame. The at least one blade extends longitudinally along the frame and is movable along with the frame upon application of a force encountered during shaving between an rest position where the at least one blade is in a substantially planar configuration and a flexed position where the at least one blade is in a substantially concave or convex configuration with respect to the top surface thereof. The razor cartridge also comprises at least one flexible beam secured to the frame below the bottom surface of the at least one blade and extending longitudinally therewith. The flexible beam is normally arranged in a neutral position when the at least one blade is in its at rest position. The at least one flexible beam is deformable to a flexed position along with the at least one blade, where it is biased to facilitate the at least one blade and the frame of the razor cartridge to return to their at rest position.

Preferably, the at least one blade of the razor cartridge comprises a plurality of blades. The plurality of blades may comprise three blades.

It is also preferable for the at least one flexible beam to comprise a plurality of longitudinally extending flexible beams which extend substantially parallel to each other.

The blades of the razor cartridge may include a front end where a cutting edge is formed and a rear end remote from the cutting edge. The at least one flexible beam may comprises a plurality of hills and valleys where the hills are arranged closer to the rear end of the at least one blade and the valleys are arranged closer to the front end of the at least one blade.

The frame of the razor cartridge may comprise a plurality of ribs which extend at least partially below the bottom surface of the bottom blade. The ribs may extend transversely to the longitudinally extending flexible beam and associated blades. In this preferred embodiment, the flexible beam may comprise a plurality of segments arranged between consecutive ones of the ribs.

The razor cartridge of the present invention may also comprise a guard bar and a cap. In an embodiment where the plurality of longitudinally extending flexible beams are included, one of the flexible beams may be arranged below the guard bar while another of the flexible beams may be arranged below the cap.

In an embodiment where at least one of the flexible beams comprise a plurality of consecutively arranged segments, such segments may be substantially u-shaped.

The present invention contemplates various structural embodiments of the flexible beams. Thus, the razor cartridge may include flexible beam means attached to the frame thereof which extend longitudinally therealong for facilitating associated blades and the frame to return from the flexed position to the at rest position. The flexible beam means may be arranged below the bottom surface of the bottom blade.

In accordance with another aspect of the present invention, a razor assembly is provided. The razor assembly comprises a flexible razor cartridge as described above in combination with a handle.

The above features and advantages of the present invention will be more fully understood with reference to the following detailed description when taken in conjunction with the accompanying drawings.

DETAILED DESCRIPTION OF THE PREFERRED EMBODIMENTS

Figure 1:
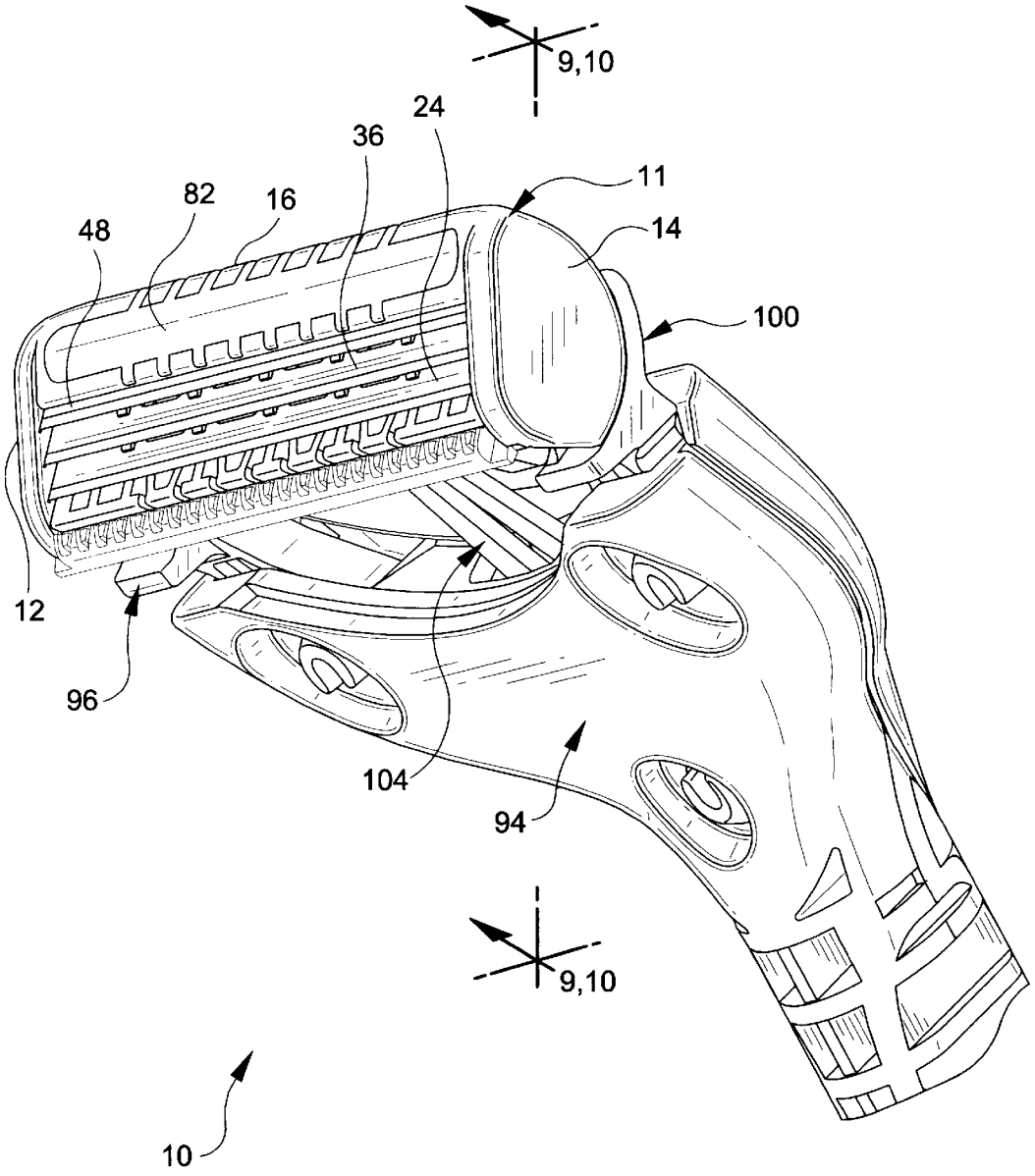
FIG. 1 is a perspective view of a preferred embodiment of the present razor cartridge.

With reference to FIGS. 1–10, the razor assembly 10 includes a cartridge 11 and an associated handle assembly 94. The cartridge 11 has opposing first and second end members 12 and 14 with a central section of a frame generally designated 16 extending therebetween. In the preferred embodiment, the frame 16 is integral with the first and second opposing end members 12 and 14.

Figure 2:
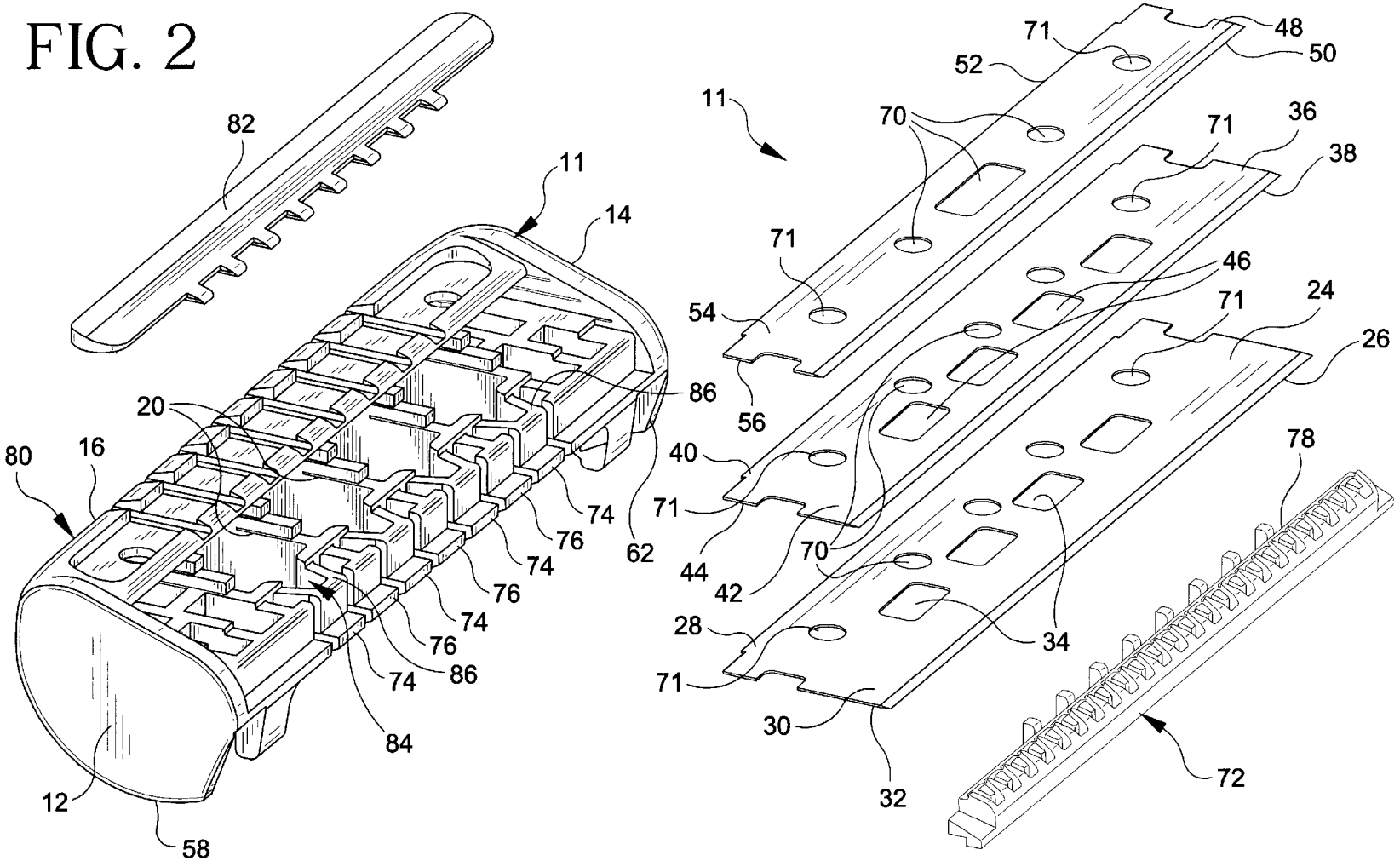
FIG. 2 is an exploded view of the razor cartridge shown in FIG. 1.
Figure 3:
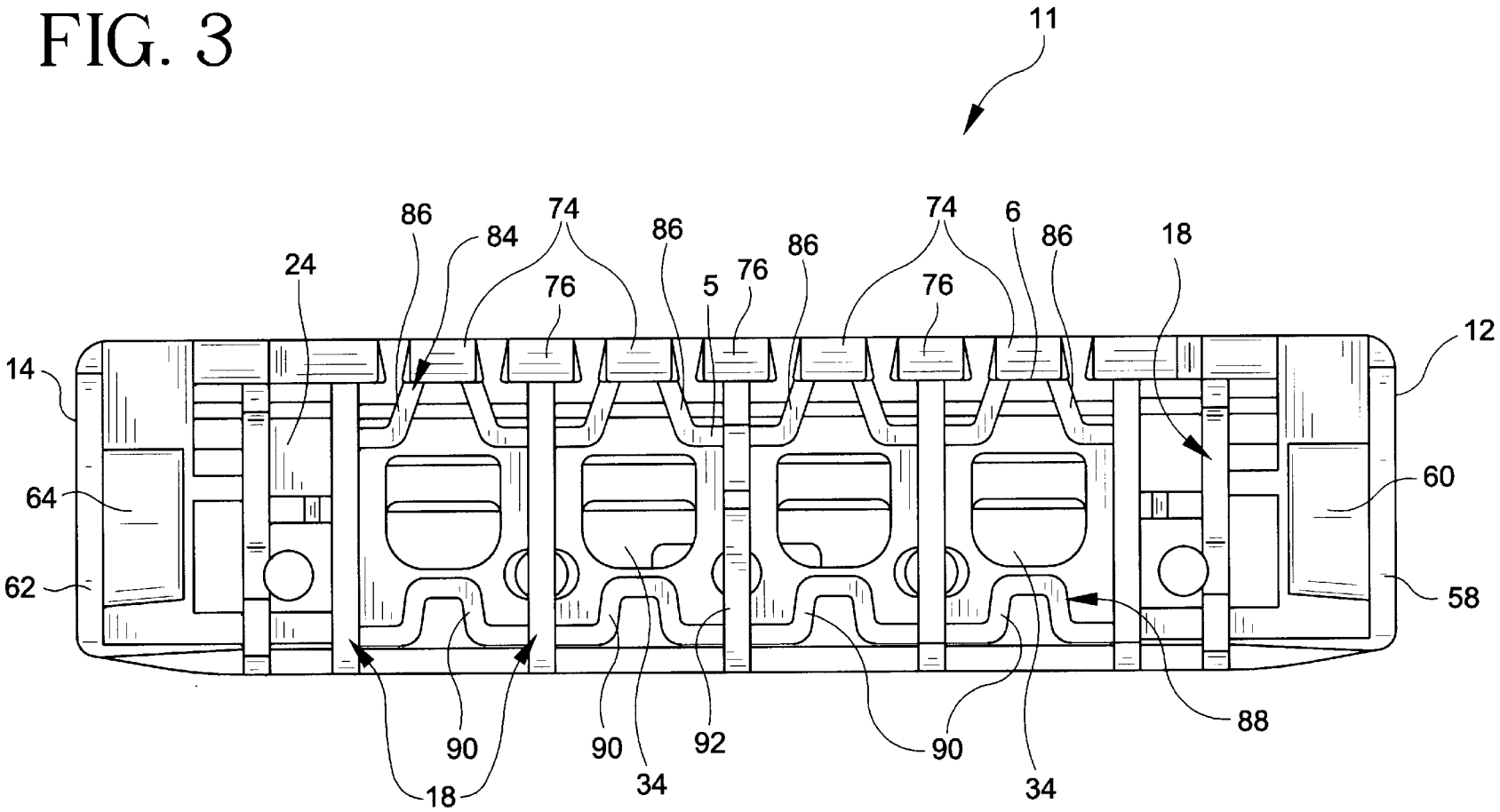
FIG. 3 is a bottom plan view of the razor cartridge shown in FIG. 1.
Figure 4:
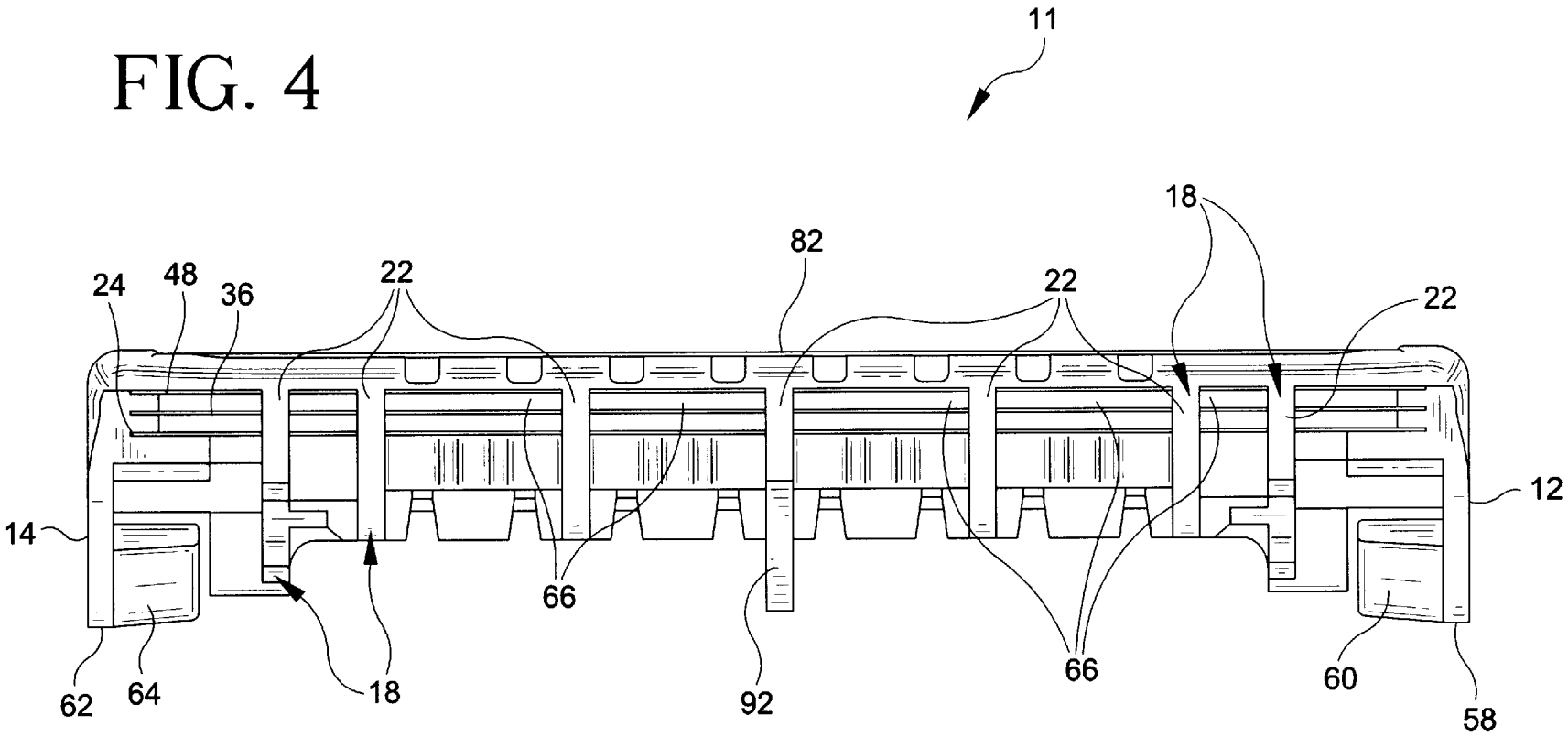
FIG. 4 is a rear view of the razor cartridge shown in FIG. 1.
Figure 5:
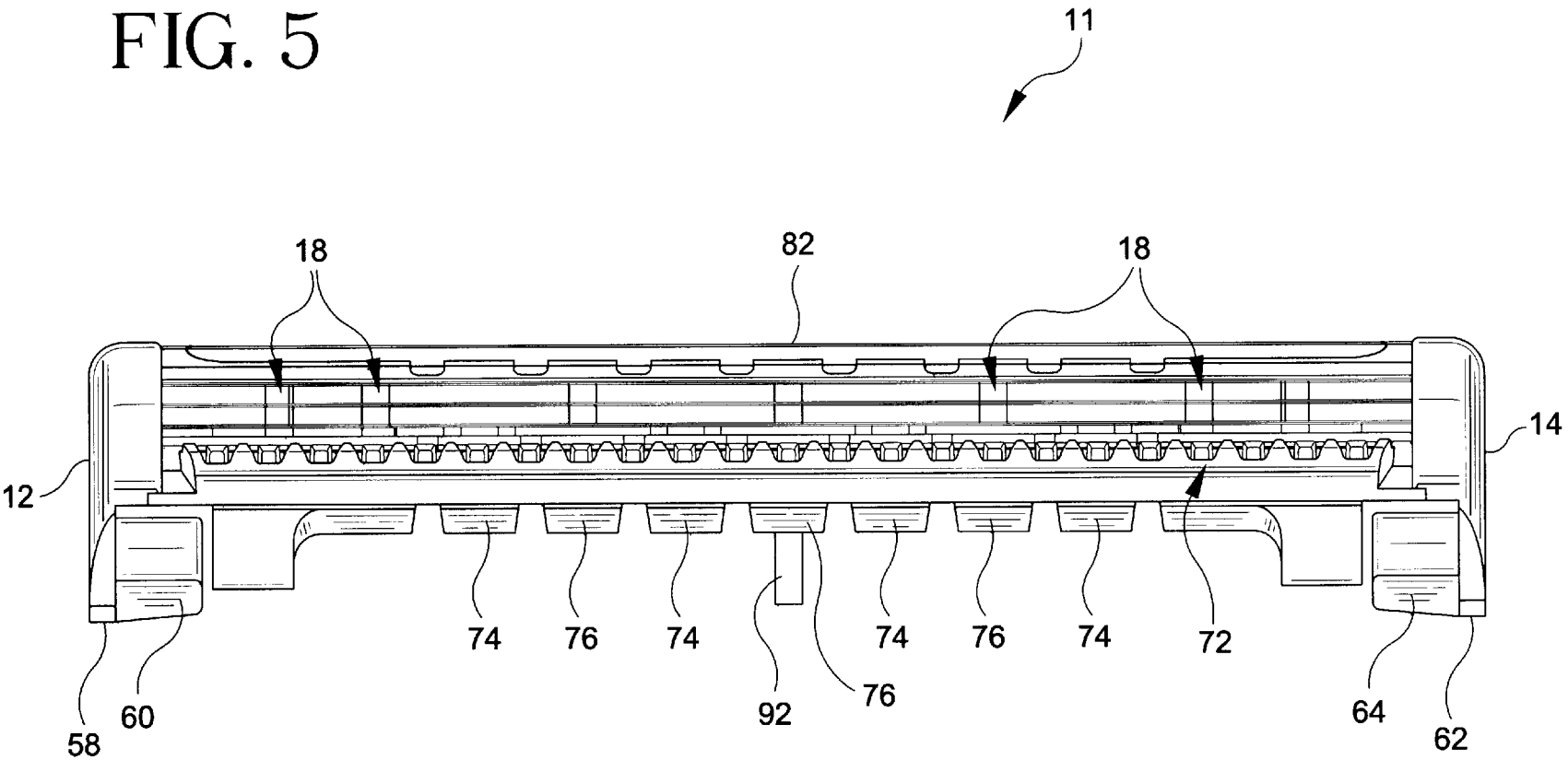
FIG. 5 is a front view of the razor cartridge shown in FIG. 1.
Figure 6:
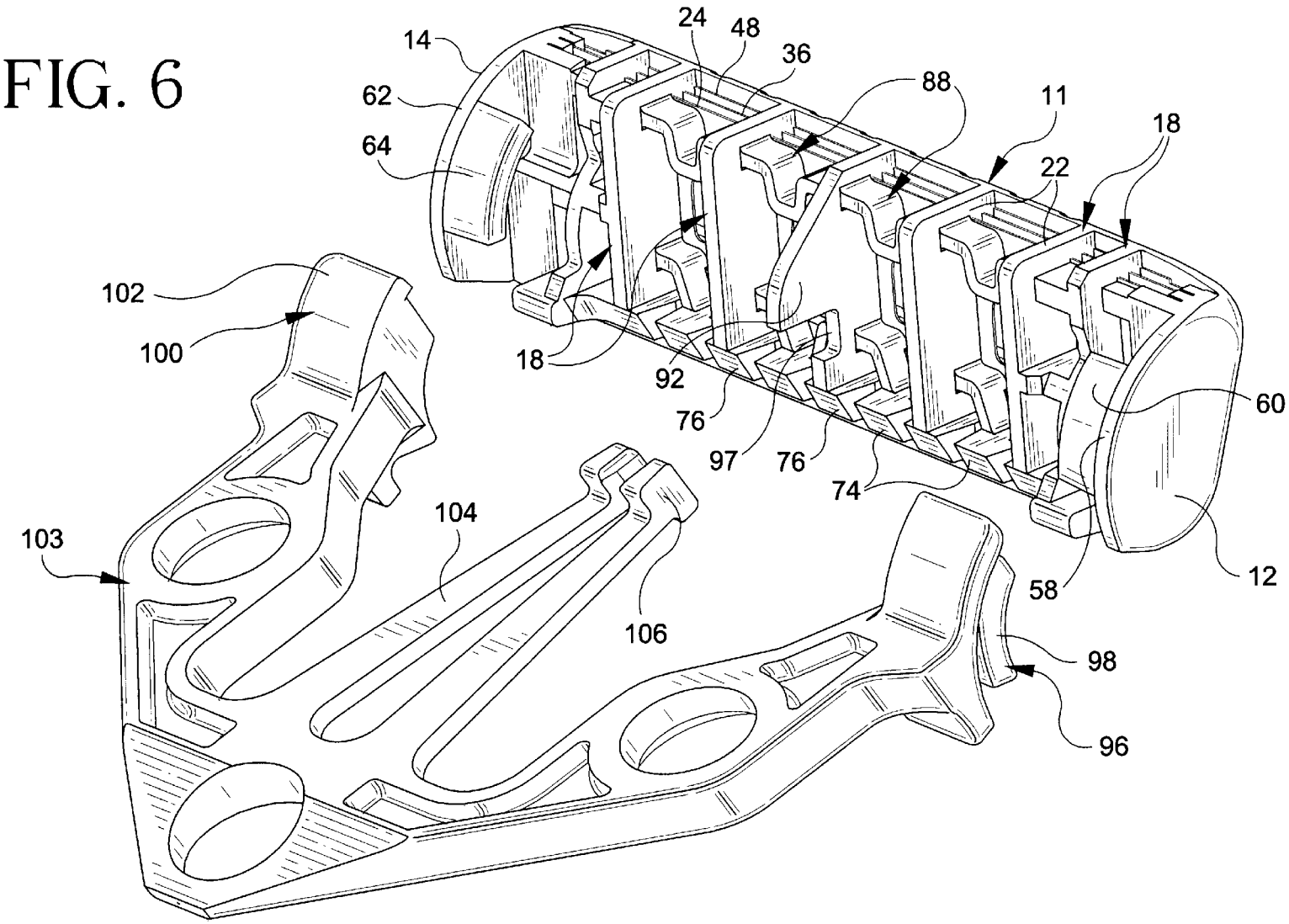
FIG. 6 is a partially exploded perspective view of the present razor cartridge and a portion of an associated handle.
Figure 7:
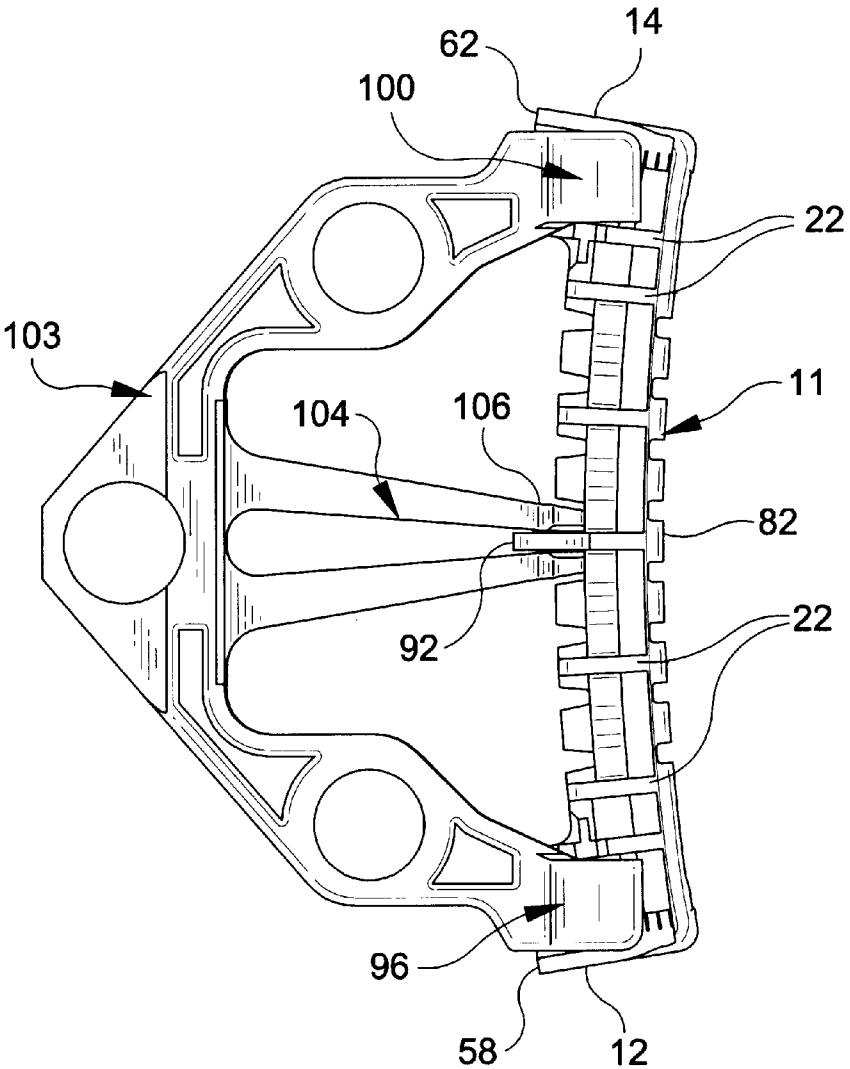
FIG. 7 is a rear view of the razor cartridge illustrated in a mounted position on a portion of an associated handle and shown in a flexed configuration.

The frame 16 includes a plurality of vertically arranged ribs 18 as shown in FIGS. 1, 3 and 4. The ribs may be equidistantly spaced from each other. In alternate embodiments, the razor cartridge 11 may include one or more vertically arranged ribs unevenly spaced from each other. In the preferred embodiment shown in FIGS. 1–10, ribs 18 provide support for razor blades 24, 36 and 48. Each of the ribs 18 include several longitudinal slots 20 in which the razor blades 24, 36 and 48 are arranged. The ribs have a rear face 22 as shown in FIGS. 4, 6 and 7.

Although the cartridge 11 shown in the preferred embodiment of FIG. 1 is a triple bladed cartridge including a seat blade 24, an intermediate blade 36 and a top blade 48, various aspects of the present invention may be used with a cartridge having more or less than three blades. The cartridge 11 includes a seat blade 24 having a cutting edge 26 and a rear edge 28.

The seat blade 24 includes a top surface 30 and a bottom surface 32. As best shown in FIGS. 2 and 3, the seat blade 24 includes a plurality of large wash-through holes 34. In a preferred embodiment, each of the wash-through holes 34 is larger than the wash-through holes of prior art razor blades, and may encompass a total area of about 8.0–13.0 $mm^2$, and is more preferably about 12.3 $mm^2$. Of course, in alternate embodiments, the size of the wash-through holes 34 may vary outside of the preferred range. As shown in FIG. 2, the seat blade 24 is supported on the frame 16 in an aligned row of slots 20 of corresponding ribs 18.

The intermediate blade 36 also includes a cutting edge 38, a rear edge 40, a top surface 42 and a bottom surface 44. A plurality of wash-through holes 46 are arranged between the cutting and rear edges 38 and 40 so as to create a passageway between the top and bottom surfaces 42–44. In a preferred embodiment, the wash-through holes 46 are also substantially larger than the wash-through holes of prior art razor blades and each may encompass a total area of about 5.0–7.0 $mm^2$, and is more preferably about 6.4 $mm^2$ As with the wash-through holes 34 of the seat blade, the size of the wash-through holes 34 may vary outside of the preferred range.

Another inventive feature of cartridge 11 is that the wash-through holes. become progressively larger in the lower blades (e.g., the wash through holes 34 of the seat blade 24 are larger than the wash-through holes 46 of the intermediate blade 36). The particular geometric configuration and dimensions of wash-through holes 34 and 46 may vary substantially in alternate embodiments of the present invention. In certain embodiments, each of the wash-through holes may encompass a total area of at least 4 $mm^2$. However, in other embodiments, each of the wash through holes in the various blades of cartridge 11 may encompass a total area of less than 4 $mm^2$.

The cartridge 11 also includes a top blade 48. Unlike the seat blade 24 and the intermediate blade 36, the top blade 48 need not include any wash-through holes. In a preferred embodiment, the top blade 48 is somewhat conventional in that it includes a cutting edge 50, a rear edge 52, a top surface 54 and a bottom surface 56. However, in alternate embodiments, the top blade 48 may also include wash-through holes.

Figure 9:
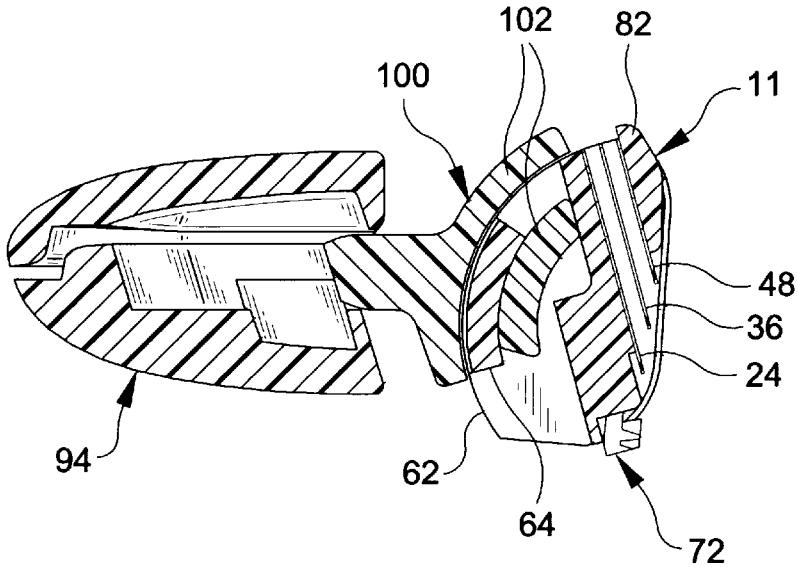
FIG. 9 is a schematic side cross-sectional view of the razor assembly of FIG. 1 shown in an at rest position.
Figure 10:
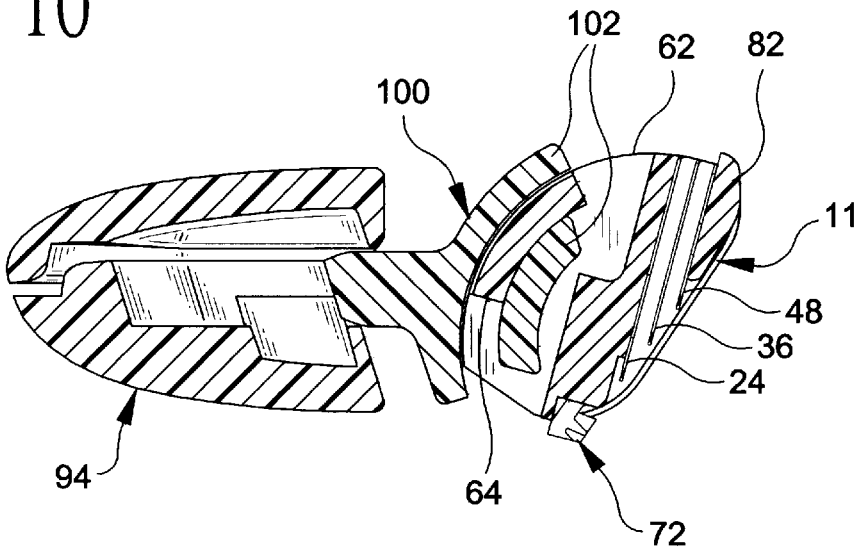
FIG. 10 is a schematic side cross-sectional view of the razor assembly of FIG. 9 shown in a pivoted configuration.

With respect to the triple-bladed construction of the cartridge 11, as shown in FIGS. 1, 9 and 10, the associated razor blades (i.e., seat blade 24, intermediate blade 36 and top blade 48) have a progressively shorter width (from their rear to front edges) in order to maintain desired span and exposure angles for shaving efficiency. However, the present invention is not limited to any particular blade dimension, configuration or geometry.

In the preferred embodiment described herein and shown in the accompanying drawings, the entire razor assembly 10 of the present invention is disposable. However, in alternate embodiments of the present invention, only the cartridge may be disposable.

The purpose of wash-through holes 34 and 46 is to facilitate removal of shafting cream and hair which may become lodged between blade surfaces during shaving. The cartridge 11 is generally designed to maximize rinsability (i.e., wash-through). While one aspect of the improved wash-through is due to the arrangement of the wash-through holes, another aspect relates to the straight wash-through as discussed below.

It is desirable to maximize the overlap of the wash-through holes 34 and 46. In the preferred embodiment where the wash-through holes 34 of the seat blade 24 are larger than the wash-through holes 46 of the intermediate blade 36, it is desirable to maximize the area of each wash-through hole 34 arranged directly above a corresponding area of one of the wash-through holes 46.

In a preferred embodiment, a relatively small distance may exist between the forward-most portion of wash-through holes 46 and the forward-most edge of intermediate blade 36. In other embodiments, the edge of intermediate blade 36 may be positioned so that it is actually arranged over a portion of the wash-through holes 46. While this arrangement is desirable from a wash-through perspective, it is difficult to achieve due to desired span and exposure, dimensions and angles.

It is also desirable for the side edges of each wash-through hole 34 to be arranged over a corresponding wash-through hole 46. However, in alternate embodiments, it is not necessary for the side edges of wash-through holes 34 to overlap corresponding wash-through holes 46.

Yet another significant aspect of the present invention is that the cartridge 11 facilitates a straight wash-through (i.e., from the front through the rear of the blades) of otherwise trapped shaving cream and hair in that it does not include a solid rear wall. Instead, the only rear wall sections of the cartridge 11 are those associated with first and second end members 12 and 14 and the rear faces 22 of the ribs 18. As illustrated in FIG. 4, the cartridge 11 includes relatively large open sections 66 through which deposited shaving cream and hair can be rinsed. This aspect of the present invention will also be discussed further below in connection with the operation thereof. In a preferred embodiment, the open sections 66 encompass a greater width than the solid wall sections, such as the width of rear face, 22 of rib 18. By way of example, each of the open sections 66, may have a width of about 5.2 mm, while the width defied by each of the rear faces 22 of ribs 18 may be about 0.8 mm.

While the combination of the progressively larger wash-through holes and the straight wash-through feature facilitate the substantially improved wash-through characteristics of the cartridge 11, it should be appreciated that each of these features by themselves provide substantial advantages over prior art razor cartridges. Similarly, the relatively large wash-through hole size by itself is also an advantageous feature.

As illustrated in FIGS. 1, 2, 6 and 8, the first end member 12 includes an arcuate bottom surface 58 and a journalled end member 60 which extends inwardly toward the second side member 14. Similarly, the second side member 14 includes an arcuate bottom surface 62 and a journalled end member 64, which extends inwardly toward the first end member 12. The journalled end construction of cartridge 11 is an innovative feature which facilitates improved pivotability between the cartridge 11 and handle assembly 94. As shown in FIG. 5, the journalled end members 60 and 64 are tapered inwardly to allow the cartridge to pivot while it is in a flexed configuration.

In a preferred embodiment, the axis about which the cartridge 11 pivots extends between the cap 80 and guard bar 72, and is located on the shave plane (i.e., a tangent line between the cap and the guard bar). This arrangement optimizes blade contact with a person's skin during shaving.

In a preferred embodiment, the curved journalled end members 60 and 64 are integral with their corresponding side members 12 and 14 and extend inwardly toward the other side member. Further, journalled end members 60 and 64 preferably follow the contour of associated arcuate bottom surfaces 58 and 62, respectively.

In addition to being mounted within the slots 20 of the ribs 18, the razor blades 24, 36 and 48 may be secured in assembled position within the cartridge frame 16 by posts (not shown) which extend through corresponding post holes 70 (FIG. 2) arranged near the rear section of all of the blades. As is known in the shaving razor field, the posts may be formed when the cartridge 11 including the blades are retained in a fixture. Outer holes 71 may have the same configuration as post holes 70, but are used to locate the razor blades 24, 36 and 48 during the manufacturing process.

The cartridge 11 is shown in FIGS. 1, 2 and 5 as including a guard bar 72. As is known to those skilled in the art, a guard bar is designed to be the first element of a safety razor to contact a person's skin during the shaving stroke. The guard bar 72 will control the manner in which the skin approaches the cutting edge 26 of the seat blade 24. The guard bar 72 may be a molded rubber strip 70 having a herring bone design or other desired design to facilitate the flow of skin over the guard bar segments during shaving.

In assembled position, the guard bar 72 is retained on a seat formed of segments 74 and 76, which have a unique structure. In particular, each of the segments 74 are formed on a portion of a front horizontal beam 84 (described further below), while each of the segments 76 are formed on the forward-most portion of corresponding ribs 18. The flexible beam may be connected to different ones of said plurality of segments than the plurality of ribs.

The cartridge 11 also includes a cap 80, which forms a part of frame 16. The cap 80 is arranged above and in back of the top blade 48. As evident from FIG. 1, 2 and 7, a shaving aid 82 may be arranged on cap 80. Various materials have been used in the prior art as shaving aids and may also be used in connection with the present invention. The term "shaving aid" as used herein, refers equally either to the active ingredient combined with a delivery system, such as a water-insoluble microporous matrix structure or to the active ingredient alone. Previously suggested active ingredients include those in U.S. Pat. No. 4,170,821 to Booth, which is hereby incorporated by reference. A shaving aid may comprise one of various combinations of the following:

A. A lubricating agent for reducing the frictional forces between the razor and the skin, e.g., a microencapsulated silicone oil.

B. An agent which reduces the drag between the razor parts and the shaver's face, e.g., a polyethylene oxide in the range of molecular weights between 100,000 and 6 million; a non-ionic polyacrylamide; and/or a natural polysaccharide derived from plant materials such as "guar gum."

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium lauryl sulphate.

E. A medicinal agent for killing bacteria, or repairing skin damage and abrasions.

F. Cosmetic agent for softening, smoothing, conditioning or improving the skin.

G. A blood coagulant for the suppression of bleeding that occurs from niches and cuts.

H. An astringent for constricting blood vessels thereby stemming the flow of bodily fluids such as lymph which may exude from skin which has been irritated during shaving.

Alternatively, the shaving aid may comprise one or more of these shaving aids disclosed in U.S. Pat. Nos. 5,056,221; 4,044,120; and 5,095,619, which are also incorporated herein by references.

Other activate ingredients may include various pigments, e.g., titanium dioxide, fragrances, aloe vera, flavoring agents, mineral oils, essential oils and other oils derived from plants. In addition to one or more active ingredients, the shaving aids of the present invention may also comprise other compounds or blends of compounds such as water insoluble polymers such as polystyrene and polypropylene.

Figure 8:
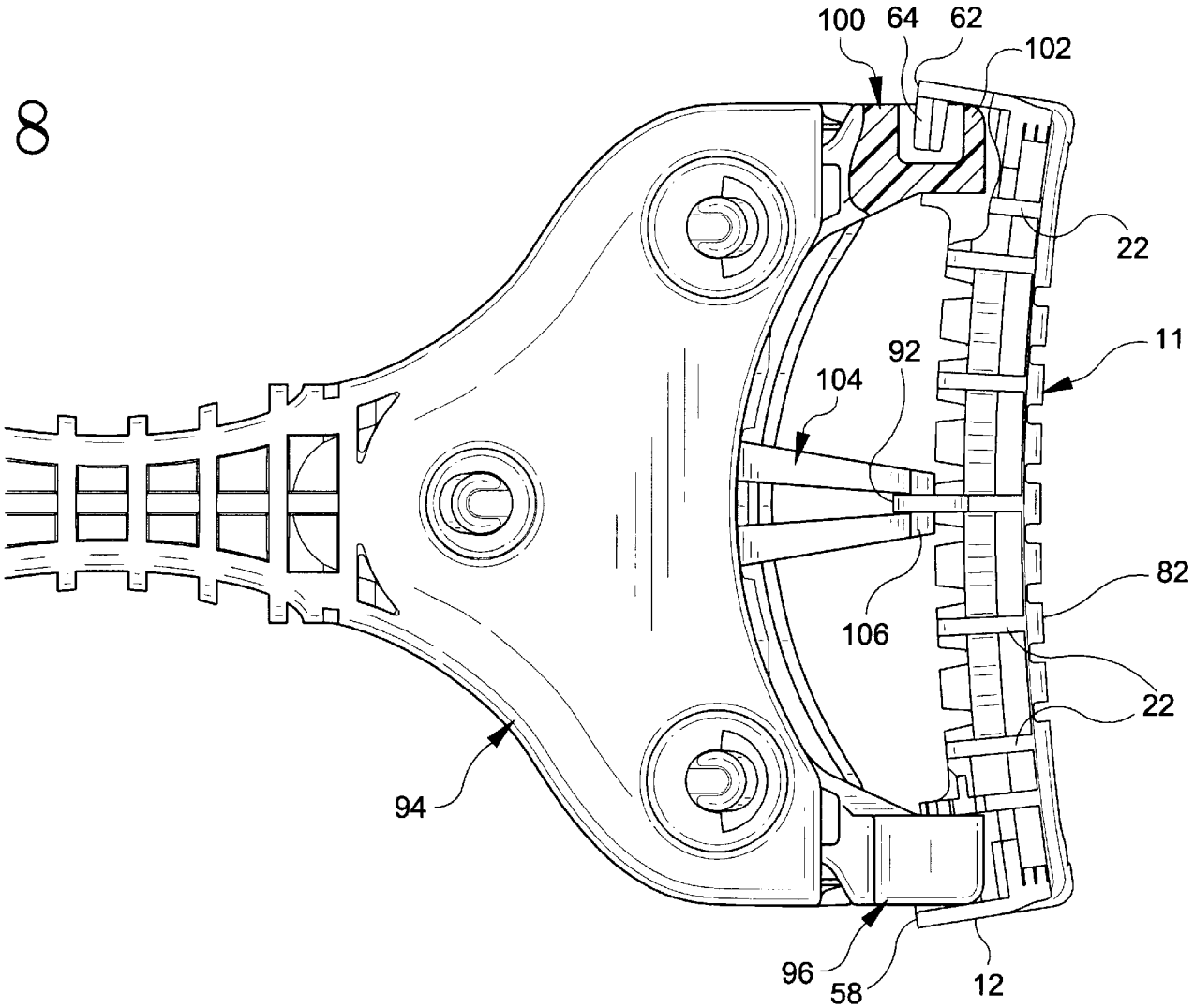
FIG. 8 is a partial cross-sectional view of the razor cartridge shown in FIG. 7.

Although the particular type of shaving aid utilized is not a significant aspect of the present invention, it is inventive that in a preferred embodiment, the razor cartridge 11 is constructed and arranged to flex through an imaginary plane which extends through the shaving aid 82. Such flexing of the razor cartridge 11 is shown in FIGS. 7 and 8. When the razor cartridge 11 flexes, each of the razor blades 24, 36 and 48 bend from their rest position, where they have a substantially planar configuration to a configuration where the top surfaces thereof obtain a concave configuration. However, it should also be appreciated that the razor cartridge 11 may also flex so that the blades obtain a convex configuration with respect to the top surfaces thereof. Such flexing may be desirable in, for example, a women's razor.

Further, when the razor cartridge 11 flexes, it is preferable for the intermediate and seat blades 36 and 24 to slide longitudinally relative to each other within slots 20. This arrangement further facilitates flexibility of the cartridge and allows the vertical spacing between the blades to remain substantially constant during flexing.

Another significant aspect of the cartridge 11 is that it includes horizontally extending beams, such as front beam 84 and rear beam 88 which facilitate the flexible nature of the cartridge 11. The beams preferably have a series of hills 5 and valleys 6. In particular, the front horizontal beam 84 comprises a plurality of segments 86 which collectively form a saw-tooth pattern. The cartridge 11 also includes a rear horizontally extending beam 88 that comprises separate segments 90 which have an appearance substantially similar to the collective appearance of the segments of the front horizontal beam 84. The segments 86 and 90 are arranged between respective ribs 18 on the cartridge frame 16. The segments 86 of front beam 84 are formed in conjunction with guard bar segments 74, as best illustrated in FIG. 3.

The structure of the front beam 84 and rear beam 88 are also inventive in various ways including their generally horizontally extending structure. In addition, the connection between the segments 86 of the front horizontally extending beam 84 and guard bar segments 74 is inventive.

The front beam 84 and rear beam 88 are generally constructed and arranged to flex along with cartridge frame 16 when an appropriate force is encountered during shaving. Upon flexing, horizontal beams 84 and 88 are placed under tension and thus bias the cartridge frame 16 to return to its at-rest position where the blades 24, 36 and 48 are in a substantially planar configuration. Thus, one function of horizontal beams 84 and 88 is to bias the razor cartridge 11 to return to its at-rest position from a flexed position.

The combination of front beam 84 and rear beam 88 is also beneficial in that it provides structural integrity to the cartridge 11. In particular, such combination helps prevent the cartridge 11 from twisting when shaving forces are applied.

Yet another significant aspect of the present invention is that the razor assembly 10 includes a cartridge 11 which is both flexible and pivotable. The center rib 18 includes a downwardly extending bearing surface 92 which, is used, in a preferred embodiment to facilitate pivoting of the cartridge 11 as discussed below.

As shown in FIG. 6, the center rib 18 also includes a notch 97 to provide clearance from a contact surface 106 of a spring arm 104 to allow the cartridge 11 to flex where the top surface of the blades obtain a concave configuration. The notch 97 includes an upper surface that acts as a stop with respect to the contact surface 106 so that the cartridge 11 will not overflex.

The razor assembly 10 also includes a handle assembly 94 on which the cartridge 11 is pivotably mounted. In particular, the handle assembly 94 includes first and second side curved journal members 96 and 100, respectively. This aspect of the present invention is shown in FIGS. 1 and 6–10. The first side curved journal member 96 includes capture member 98 while the second side curved journal member 100 includes capture member 102. As evident from FIG. 8, the cartridge 11 is mounted on the handle assembly 94 by securing the arcuate journalled end members 60 and 64 on corresponding first and second curved journal members 96 and 100. More particularly, the curved journalled end members 60 and 64 of cartridge 11 are arranged within the curved passageway formed between a corresponding one of the curved journal members 96 and 100 and their respective capture members 98 and 102. This mounting structure may be considered a "clam shell" pivot arrangement formed by the cooperating curved journal members 96 and 100 with the curved journalled end members 60 and 64 of the cartridge 11.

As schematically illustrated in FIG. 9, the cartridge 11 of razor assembly 10 is initially biased to its rear-most position. As used herein, this rearward biased cartridge arrangement is also referred to as a "unidirectional" pivot arrangement. Such arrangement has certain advantages such as the elimination of deadband (i.e., where the cartridge is not under a spring-loaded or other bias force). The existence of deadband is undesirable because it may result in vibration of the cartridge 11 during handling of the razor assembly 10. However, it should be appreciated that the particular pivot arrangement may be modified in alternate embodiments of the present invention. For example, a forward biased (also unidirectional) or center biased pivot arrangement (bidirectional) may be used in place of the rearward biased pivot arrangement.

In the rearward biased embodiment schematically shown in FIG. 10, an upwardly extending spring arm 104 (best shown in FIGS. 6 and 7) extends from an end of the handle assembly 94. The spring arm 104 includes contact surface 106 at a top portion thereof which engages the downwardly extending bearing surface 92 from the center rib 18 of the cartridge 11. This structure urges the cartridge 11 to pivot to its rear-most position when the razor assembly 10 is not in use.

The contact surface 106 of spring arm 104 includes two bosses that provide a groove through a central portion of contact surface 106. The groove (unnumbered) receives the center rib 18 of the cartridge 11. When the cartridge 11 flexes during shaving, the journalled end members 60 and 64 open up as illustrated in FIG. 7. The groove between the bosses maintain the cartridge 11 in a centered position.

The spring arm 104 has a substantially elongated triangular shape which provides for a desired degree of stiffness to help prevent side-to-side travel of cartridge 11. As best shown in FIGS. 6 and 7, a central portion of the triangular shaped spring arm 104 is cut away to provide the desired spring effect and to allow the center rib 18 of the cartridge 11 to rotate during flexing and/or pivoting of the cartridge 11.

As also illustrated in FIGS. 6 and 7, in a preferred embodiment, an integral "pivot frame" 103 is provided. The pivot frame 103 includes the spring arm 104 and the first and second curved journal members 96 and 100. The integral nature of the pivot frame 103 provides for manufacturing and structural advantages.

In operation, various advantages of the structural features of razor assembly 10 become evident. When the razor assembly 10 is in its at rest position, the cartridge 11 is neither flexed nor pivoted forwardly. However, during shaving, the cartridge 11 is designed to both pivot on the handle assembly 94 and to flex, if necessary. FIGS. 1 and 9 illustrate the razor assembly 10 when arranged in its at rest position prior to shaving. However, when a force is exerted on the razor cartridge 11 during shaving, the cartridge 11 may pivot forwardly (as shown in FIG. 10) on the clam-shell connector structure formed by the first and second bearing surfaces 96 and 100, and curved capture members 98 and 102 of the handle assembly 94 in combination with the curved journalled end members 60 and 64 of the cartridge 11.

As discussed above, the cartridge 11 is constructed and arranged to flex through an imaginary plane which extends through the shaving aid 82. Such arrangement is designed to extend the life of the shaving aid 82 by minimizing cracking and wear thereof.

As is common with any multiple bladed razor, shaving cream and hair will become deposited between the surfaces of blades 24, 36 and 48 of cartridge 11 during use. It is desirable to remove such deposited shaving cream and hair as quickly and easily as possible. Efficient removal of deposited shaving cream and hair is accomplished through the use of several inventive features including the relatively large wash-through holes 34 and 46 of seat blade 24 and intermediate blade 36, respectively; the progressively larger nature of the wash-through holes 34 on seat blade 24 as compared to the wash-through holes 46 of intermediate blade 36; and the straight wash-through arrangement obtained by the open sections 66 at the open rear of cartridge 11. In this regard, when the cartridge 11 is rinsed after a shaving stroke, the water will force deposited shaving cream and hair straight through the cartridge 11 along the top and bottom surfaces of the associated blades and out of the rear sections 66. Removal of the unwanted shaving cream and hair will also be facilitated by wash-through holes 34 and 46.

It should be appreciated that although preferred embodiments of the present invention are discussed above, those of skill in the art are encouraged to modify the disclosed structure and arrangement of various features of the present razor cartridge and assembly without departing from the scope of the present invention, which is defined by the claims set forth below.

What is claimed is:

1. A razor cartridge comprising:

a frame;

at least one blade having top and bottom surfaces supported on said frame and extending longitudinally therealong, said frame and said at least one blade being movable upon application of a force encountered during shaving between an at-rest position where said at least one blade is in a substantially planar configuration and a flexed position where said at least one blade is in a substantially concave or convex configuration with respect to said top surface thereof; and at least one flexible beam secured to said frame below said bottom surface of said at least one blade and extending longitudinally therewith, said flexible beam being normally arranged in a neutral position when said at least one blade is in said at-rest position and being deformable to a flexed position along with said at least one blade, said at least one flexible beam being biased to facilitate said at least one blade and said frame to return to said at-rest position, wherein said at least one blade includes a front end where a cutting edge is formed, and a rear end remote from said cutting edge, said at least one flexible beam comprises a plurality of hills and valleys where said hills are arranged closer to said rear end of said at least one blade and said valleys are arranged closer to said front end of said at least one blade.

2. The razor cartridge of claim 1 wherein said frame comprises a plurality of ribs at least partially arranged below said bottom surface of said at least one blade, said plurality of ribs extending transversely to said longitudinally extending at least one blade and said at least one flexible beam.

3. The razor cartridge of claim 2 wherein said at least one flexible beam comprises a plurality of segments arranged between consecutive ones of said plurality of ribs.

4. The razor cartridge of claim 3 wherein said at least one blade includes a front end where a cutting edge is formed, and a rear end remote from said cutting edge, said at least one flexible beam comprises a plurality of hills and valleys where said hills are arranged closer to said rear end of said at least one blade and said valleys are arranged closer to said front end of said at least one blade.

5. The razor cartridge of claim 1 wherein said at least one flexible beam comprises a plurality of flexible beams extending substantially parallel to each other.

6. The razor cartridge of claim 5 wherein said frame comprises a plurality of ribs at least partially arranged below said bottom surface of said at least one blade, said plurality of ribs extending transversely to said longitudinally extending at least one blade and said plurality of flexible beams.

7. The razor cartridge of claim 6 wherein each of said flexible beams comprises a plurality of segments arranged between consecutive ones of said plurality of ribs.

8. The razor cartridge of claim 5 further comprising a guard bar and a cap, one of said flexible beams being arranged substantially below said guard bar and one of said flexible beams being arranged substantially below said cap.

9. The razor cartridge of claim 1 wherein said at least one blade comprises a plurality of blades, each of said blades including a front end where a cutting edge is formed and a rear end remote from said cutting edge, said at least one flexible beam including a plurality of flexible beams extending substantially parallel to each other.

10. The razor cartridge of claim 9 wherein said frame comprises a plurality of ribs at least partially arranged below said bottom surface of each said blade, said plurality of ribs extending transversely to said plurality of blades and said plurality of flexible beams.

11. The razor cartridge of claim 10 wherein at least one of said plurality of flexible beams comprises a plurality of segments arranged between consecutive ones of said plurality of ribs.

12. The razor cartridge of claim 1 wherein said at least one flexible beam comprises a plurality of consecutively arranged substantially u-shaped segments.

13. A razor cartridge comprising:

a frame;

at least one blade having top and bottom surfaces supported on said frame and extending longitudinally therealong, said frame and said at least one blade being movable upon at)plication of a force encountered during shaving between an at-rest position where said at least one blade is in a substantially planar configuration and a flexed position where said at least one blade is in a substantially concave or convex configuration with respect to said top surface thereof; and flexible beam means attached to said frame and extending longitudinally therealong for facilitating said at least one blade and said frame to return from said flexed position to said at-rest positions wherein said razor cartridge further comprises a guard bar arranged at a front in of said frame, said guard bar comprising a plurality of spaced segments and said flexible beam means being connected to said guard bar, wherein said frame comprises a plurality of ribs at least partially arranged below said bottom surface of said at least one blade, said plurality of ribs extending substantially transversely to said longitudinally extending at least one blade and being connected to at least some of said plurality of spaced segments of said guard bar and wherein said flexible beam means is connected to different ones of said plurality of spaced guard bar segments than said plurality of ribs.

14. The razor cartridge of claim 13 wherein said flexible beam means is arranged below said bottom surface of said at least one blade.

15. The razor cartridge of claim 13 wherein said flexible beam means comprises a plurality of substantially u-shaped segments.

16. The razor cartridge of claim 13 wherein said frame comprises a plurality of ribs at least partially arranged below said bottom surface of said at least one blade, said plurality of ribs extending substantially transversely to said longitudinally extending at least one blade.

17. The razor cartridge of claim 16 wherein said flexible beam means is arranged between said plurality of ribs.

18. A razor assembly comprising:

a handle; and a razor cartridge attached to said handle, said razor cartridge including a frame; at least one top blade having top and bottom surfaces supported on said frame and extending longitudinally therealong, said frame and said at least one blade being movable upon application of a force encountered during shaving between an at-rest position where said at least one blade is in a substantially planar configuration and a flexed position where said at least one blade is in a substantially concave or convex configuration with respect to said top surface thereof; and at least one flexible beam secured to said frame below said bottom surface of said at least one blade and extending longitudinally therewith. said at least one flexible beam being normally arranged in a neutral position when said at least one blade is in said at-rest position and being deformable to a flexed position along with said at least one blade whereby said at least one flexible beam is biased to return said at least one blade and said frame to said at-rest position, and wherein said at least one blade includes a front end where a cutting edge is formed, and a rear end remote from said cutting edge, said at least one flexible beam comprises a plurality of hills and valleys where said hills are arranged closer to said rear end of said at least one blade and said valleys are arranged closer to said front end of said at least one blade.

19. The razor assembly of claim 18 wherein said frame comprises a plurality of ribs at least partially arranged below said bottom surface of said at least one blade, said plurality of ribs extending transversely to said longitudinally extending at least one blade and said at least one flexible beam.

20. The razor assembly of claim 19 wherein said at least one flexible beam comprises a plurality of segments arranged between consecutive ones of said plurality of ribs.

21. The razor assembly of claim 20 wherein said at least one blade includes a front end where a cutting edge is formed, and a rear end remote from said cutting edge, said at least one flexible beam comprises a plurality of hills and valleys where said hills are arranged closer to said rear end of said at least one blade and said valleys are arranged closer to said front end of said at least one blade.

22. The razor assembly of claim 18 wherein said at least one flexible beam comprises a plurality of flexible beams extending substantially parallel to each other.

23. The razor assembly of claim 22 wherein said frame comprises a plurality of ribs at least partially arranged below said bottom surface of said at least one blade, said plurality of ribs extending transversely to said longitudinally extending at least one blade and said plurality of flexible beams.

24. The razor assembly of claim 23 wherein each of said flexible beams comprises a plurality of segments arranged between consecutive ones of said plurality of ribs.

25. The razor assembly of claim 22 further comprising a guard bar and a cap, one of said flexible beams being arranged substantially below said guard bar and one of said flexible beams being arranged substantially below said cap.

26. The razor assembly of claim 18 wherein said at least one blade comprises a plurality of blades, each of said blades including a front end where a cutting edge is formed and a rear end remote from said cutting edge, said at least one flexible beam including a plurality of flexible beams extending substantially parallel to each other.

27. The razor assembly of claim 26 wherein said frame comprises a plurality of ribs at least partially arranged below said bottom surface of said at least one blade, said plurality of ribs extending transversely to said longitudinally extending at least one blade and said plurality of flexible beams.

28. The razor assembly of claim 27 wherein at least one of said plurality of flexible beams comprises a plurality of segments arranged between consecutive ones of said plurality of ribs.

29. The razor assembly of claim 18 wherein said at least one flexible beam comprises a plurality of consecutively arranged substantially u-shaped segments.

30. A razor assembly comprising:

a handle; and a razor cartridge attached to said handle. said razor cartridge including a frame; at least one blade having top and bottom surfaces supported on said frame and extending longitudinally therealong, said frame and said at least one blade being movable upon application of a force encountered during shaving between an at-rest position where said at least one blade is in a substantially planar configuration and a flexed position where said at least one blade is in a substantially concave or convex configuration with respect to said top surface thereof; and flexible beam means attached to said frame and extending longitudinally therealong for facilitating said at least one blade and said frame to return from said flexed position to said at-rest position, wherein said razor assembly further comprises a guard bar arranged at a front portion of said frame, said guard bar comprising a plurality of spaced segments and said flexible beam means being connected to said guard bar, and wherein said frame comprises a plurality of ribs at least partially arranged below said bottom surface of said at least one blade, said plurality of ribs extending substantially transversely to said longitudinally extending at least one blade and being connected to at least some of said plurality of spaced segments of said guard bar and wherein said flexible beam means is connected to different ones of said plurality of spaced guard bar segments than said plurality of ribs.

31. The razor assembly of claim 30 wherein said flexible beam means comprises a plurality of substantially unshaped segments.

32. The razor assembly of claim 30 wherein said flexible beam means is arranged between said plurality of ribs.

* * * * *